US005494196A

United States Patent [19]

Tyner

[11] Patent Number: 5,494,196

[45] Date of Patent: Feb. 27, 1996

[54] SYSTEM FOR FILLING MEDICAL NUTRITION CONTAINERS

[75] Inventor: Clifford A. Tyner, Grass Valley, Calif.

[73] Assignee: Healthtek, Inc., Nevada City, Calif.

[21] Appl. No.: 388,183

[22] Filed: Feb. 13, 1995

Related U.S. Application Data

[63] Continuation of Ser. No. 851,960, Mar. 16, 1992, abandoned.

[51] Int. Cl.[6] ..... B65D 47/02

[52] U.S. Cl. ..... 222/147; 215/47; 215/256; 222/153.1; 222/525

[58] Field of Search ..... 222/147, 522, 222/523, 525, 153.01, 153.14, 541.6, 541.1; 215/14, 47, 256

[56] References Cited

U.S. PATENT DOCUMENTS

| | | | |
|---|---|---|---|
| Re. 32,354 | 2/1987 | Savage . | |
| 159,200 | 1/1875 | Michell | 222/525 X |
| 318,290 | 5/1885 | Piper . | |
| 2,324,237 | 3/1941 | Reichel . | |
| 2,486,729 | 6/1948 | Beckley . | |
| 2,969,168 | 1/1961 | Newby | 222/525 |
| 2,992,761 | 7/1961 | Sommers, Sr. | 222/525 X |
| 2,992,762 | 7/1961 | Forman | 222/525 X |
| 3,157,323 | 11/1964 | Kitterman | 222/525 X |
| 3,245,587 | 4/1966 | Brown | 222/525 X |
| 3,641,999 | 2/1972 | Greene | 222/107 X |
| 3,777,936 | 12/1973 | Hazard | 222/525 X |
| 4,244,409 | 1/1981 | Wilson et al. | 222/107 |
| 4,396,383 | 8/1983 | Hart . | |
| 4,410,026 | 10/1983 | Boggs et al. . | |
| 4,672,993 | 6/1987 | Bilak . | |
| 4,854,737 | 8/1989 | Steer et al. . | |

FOREIGN PATENT DOCUMENTS

| | | | |
|---|---|---|---|
| 787791 | 9/1935 | France | 222/525 |
| 78778 | 5/1918 | Switzerland | 222/525 |
| 601043 | 4/1948 | United Kingdom | 222/525 |

*Primary Examiner*—Kevin P. Shaver
*Attorney, Agent, or Firm*—Lyon & Lyon

[57] ABSTRACT

A tamper resistant filling and containment system useful in medicinal and related applications. A bladder includes at least two ports with one of the ports having a graspable, reciprocable tube inserted therein. The tube has an axially bore formed partially therethrough which terminates at side passages which communicate with the bladder when the tube is in a filling position. Movement of the tube to a second position prevents communication of the side passages with the bladder and a weakened portion of the tube located at the side passages permits the graspable or outer portion of the tube to be broken, thereby preventing access to the tube and movement thereof to the filling position.

7 Claims, 2 Drawing Sheets

SYSTEM FOR FILLING MEDICAL NUTRITION CONTAINERS

This a continuation of application Ser. No. 07/851,960 filed Mar. 16, 1992, now abandoned.

BACKGROUND OF THE INVENTION

1. Field of the Invention

The present invention relates to the field of medical infusion apparatus. More specifically, the present invention relates to tamper resistant medical filling and containment systems which provide for ease in filling and use.

2. Description of the Prior Art

In medical and related applications, it is often desirable to introduce a selected amount of a fluid solution, e.g., a nutrition solution, into the body of a patient over a predetermined period of time. Systems which have been developed to address this need generally include an infusion bag having two openings, where at least one opening is connected to a tube which in turn is connected to a catheter. In practice, the plastic infusion bag is filled with a nutrition solution through a fill tube connected to one of the openings. When the bag has been filled, the fill tube is clamped shut with either a plastic clamp or a metal crimp and the free end of the fill tube is cut off and discarded.

Disadvantages which have heretofore existed with these systems include their difficulty of use, lack of aesthetic appeal and susceptibility to tampering.

The current methods suffer from clamps that are lost before they can be used, bulky and unsightly protrusions on the outside of the bag, crimps that require additional tools to use and a product that is not altogether tamper-proof.

SUMMARY OF THE INVENTION

The present invention addresses the above noted and other disadvantages of prior art filling and containment systems. The present invention comprises a filling system including an integral fill tube whereby the fill tube may be essentially removed from the system and bag when the filling operation is completed without the use of tools or separate crimps or clamps. Moreover, the infusion bag, once filled, is resistant to tampering.

In a preferred embodiment, the system includes a collapsible infusion bag provided with two or more openings formed at one end or edge of the bag in a conventional fashion. These openings include at least one fill port through which the bag may be filled, and at least one outlet port which may be connected to a flow conduit which in turn may be connected to a catheter. The fill port used to introduce a given fluid solution into the bag is receivable to a valve comprising a cylindrical body which may be reciprocated between an "open" and a "closed" position. This cylindrical is preferably hollow along at least a portion of its length to allow for fluid flow therethrough. When positioned in an "open" position, the valve allows a given fluid to be introduced into the bag. When moved to a "closed" position within the fill port, external ridges on the outer diameter of the valve press against the inner wall of the port, effectively seating the valve stem. When maintained in a "closed" position over a period of time, the elastic memory of the plastic forming the opening preferably secures the valve stem in this "closed" position.

In another preferred embodiment, a reciprocating valve comprises a cylindrical body with a smaller diameter portion situated along its length. This smaller diameter portion allows the exposed filling end of the valve to be removed once the valve is moved to a "closed" position. In such a fashion, the valve cannot easily be reciprocated to an "open" position so as to allow access to the fluid contents of the bag.

The filling system of the present invention has a number of advantages over the prior art. One such advantage is the increased ease in the filling operation provided by the reciprocating valve comprising the cylindrical body and the fill port.

Another advantage of the present invention is that it removes the need to use a separate tube clamp or other similar mechanism to prevent fluid flow through the neck of the filling port after the bag is filled. Still another advantage is the fact that the system can be closed without the need for additional tools. Moreover, the filled container is more aesthetically pleasing due to the elimination of the tube clamp and is tamper resistant.

Other advantages of the invention will become apparent to those skilled in the art in view of the following detailed description and accompanying drawings.

DESCRIPTION OF THE PREFERRED EMBODIMENT

Figure 2:
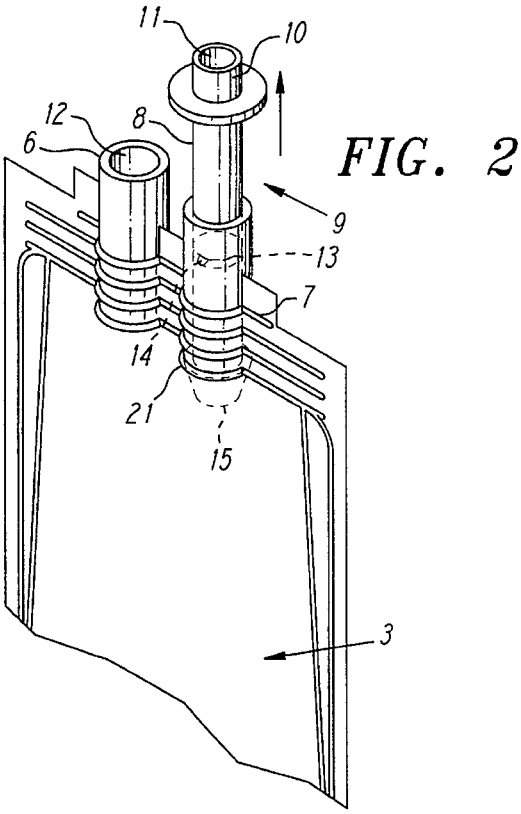
FIG. 2 illustrates the embodiment disclosed in FIG. 1 where the valve is disposed in a "closed" position.
Figure 1:
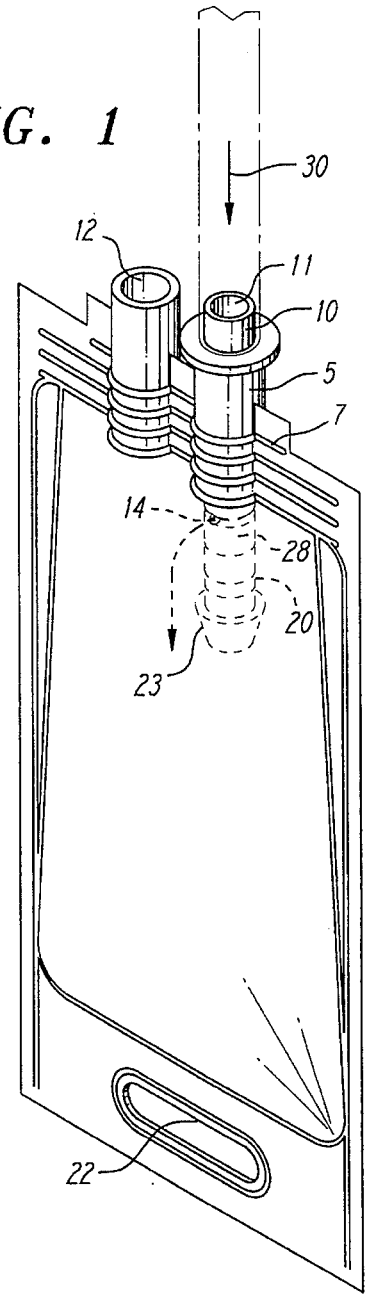
FIG. 1 illustrates a perspective view of one embodiment of the infusion system of the present invention wherein the valve is shown situated in an "open" position.
Figure 3:
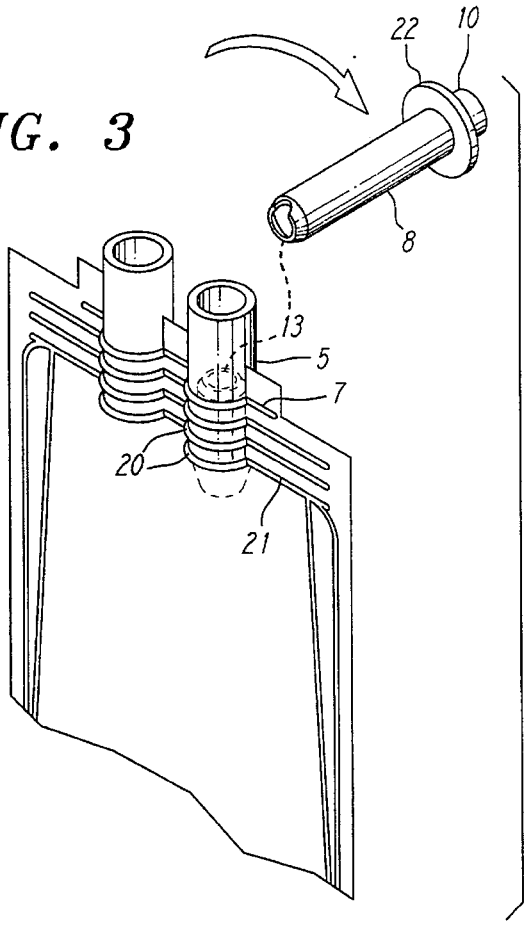
FIG. 3 illustrates the view of the embodiment disclosed in FIG. 2 wherein the filling end of the reciprocating valve has been removed.

In accordance with a preferred embodiment of the present invention by reference to FIGS. 1–3, there is provided an infusion bag 3 and a valve 9. Infusion bag 3 described herein is preferably made from two superimposed sheets of plastic material welded around their edges to form a gas-tight bladder. In a preferred embodiment, a malleable gas impermeable plastic, such as Non-Dop PVC as manufactured by Ella Plastics, is used, although other types of materials having similar properties are also contemplated within the spirit of the invention. As illustrated in FIGS. 1–3, an infusion bag 3 is preferably rectangular in shape although other configurations may also be used. It is desirable, however, that the bag 3 be provided with a handle 22 or other means to carry and suspend the bag 3 as will be further described herein.

Fluid communication with the bladder formed within the bag 3 is provided by two or more necks or openings including an inlet port 5 and an outlet port 6. As noted, the inlet port 5 preferably describes a tubular bore 12 to accommodate valve stem 8. As illustrated in FIGS. 1–3, ports 5 and 6 are preferably provided with reinforcing ribs 7 or the like to enhance their axial rigidity. Outlet port 6 is sealed via a puncturable membrane (not shown) by methods well known in the art. When administration of the liquid within the bladder to a patient is desired, this membrane is punctured by a flow spike or the like which is coupled to a transport conduit such as a tube (not shown), which in turn is coupled to a catheter (also not shown) for delivery of the liquid within the bag to the patient. Port 5 is comprised of an exterior end 25, an interior end 24 and an inner wall 26 as shown best in FIGS. 4 and 5.

Figure 4:
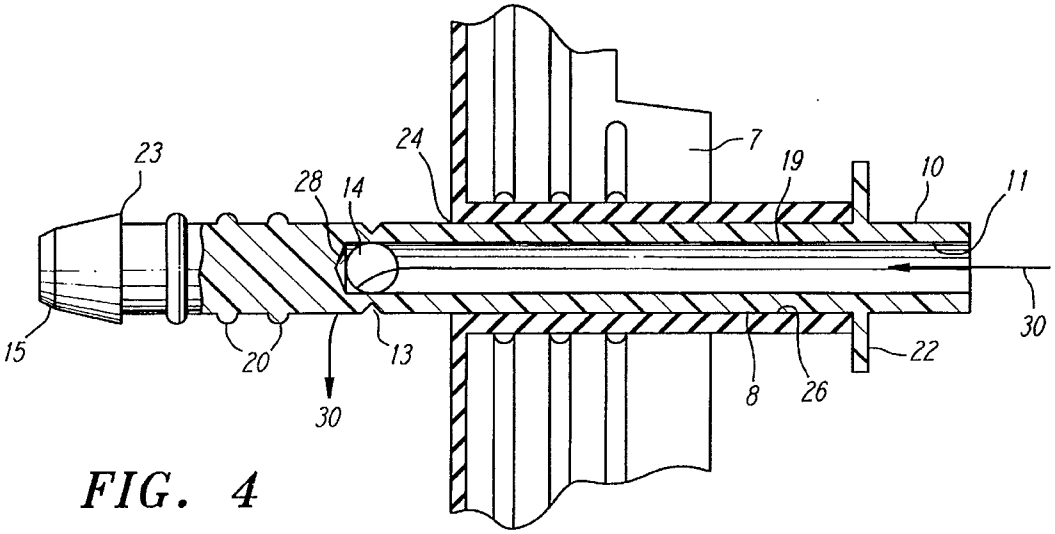
FIG. 4 is a view in partial cross section of the valve as depicted in FIG. 1.
Figure 5:
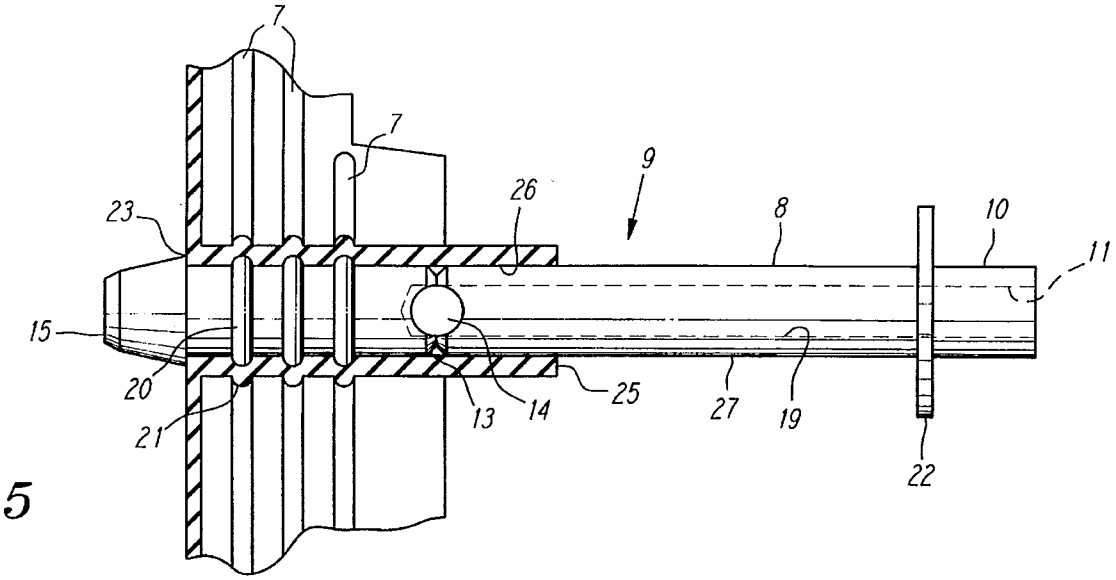
FIG. 5 is a view in partial cross section of the valve as depicted in FIG. 2.

Referring again to FIGS. 1–3 and especially to FIGS. 4 and 5, reciprocating valve 9 comprises the inlet or fill port 5, which in this embodiment acts as the valve body, and an elongate cylindrical body or valve stem 8. The elongate cylindrical body 8 includes a bladder end 15 and a filling end 10. Valve stem 8 is adapted to reciprocate within the tubular bore 12 defined in inlet port 5 in a fluid-tight relationship. The movement of valve stem 8 in this fashion is illustrated in FIGS. 1–2. The filling end 10 of valve stem 8 is adapted to be coupled to a standard conduit means such as nylon or PVC tubing (not shown) to allow the bag to be filled. Preferably, this coupling is accomplished by tapering filling end 10 to allow for a friction fit with standard medical grade tubing. This filling operation is ordinarily accomplished at the pharmaceutical supply house or, in some instances, at the hospital. Filling end 10 includes a shoulder 22 to assist the user in moving the valve stem 8 between a first, or "open", and a second, or "closed", position as will be described below.

Valve stem 8 is comprised of a longitudinal bore 19 extending from the filling end 10 to a point situated between the filling end 10 and the dispensing end 15. An aperture 11 is formed at the filling end 10. Fluid flow through the valve 8 into the bag 3 is enabled by one or more passages 14 formed approximately mid way between the bladder end 15 and the filling end 10 of the cylindrical body 8. These passages 14 are in fluid communication with the bore 19. In a preferred embodiment, passages 14 are formed at the bottom of and transverse to the bore 19. Other relative orientations may also be used to accomplish the objectives of the invention.

Passages 14 are located at a point along the valve stem 8 to provide fluid communication between the aperture 11 and the bladder in the bag 3 when the valve 8 is in the "open" position. Conversely, there is no fluid communication when the valve 8 is in the closed position. As shown in FIG. 1, the valve 8 is "open" when the cylindrical body 8 is pushed into the bag 3 such that the shoulder 22 abuts the end of the inlet port 5. In this position, fluid (depicted by arrows 30 in FIG. 4) enters the valve stem 8 at aperture 11, flows through the bore 19 to passages 14 on into the bladder defined within bag 3. The valve 8 is "closed" by grasping the shoulder 22 and pulling the cylindrical body 8 until the stop 23 abuts the interior end 24 of the inlet port 5. As can be seen from FIG. 5 and FIG. 2, in the "closed" position, passages 14 are effectively blocked by the interior wall 26 of the port 5, thus, preventing fluid from flowing into or out of the bag 3.

In the preferred embodiment, valve stem 8 includes a smaller diameter portion 13, which effectively divides valve stem 8 into a filling portion 27 and bladder portion 28. The smaller diameter portion 13 is designed to allow the filling portion 27 to be cleanly and easily separated from the bladder portion 28 after the bag 3 has been filled, and yet strong enough to allow the valve 8 to be reciprocated in port 5. While it is well known in the art how to achieve this dual purpose, it has been found that a wedge shaped cross sectional thinning formed at the passages 14 as best shown in FIG. 4, is most effective. The objective of the smaller diameter portion 13, namely being able to prevent the valve 8 from being easily or accidentally opened after filling, may be achieved by other methods without departing from the spirit of the invention.

The bladder portion 28 of the valve 8 is preferably provided with a series of circumferential ridges 20. When the valve 9 is in the "closed" position, these ridges 20 form a series of complementary grooves 21 in the otherwise smooth interior wall 26 of port 5 due to the malleable nature of the plastic material used to form port 5. As can be seen in FIG. 5, it has been found advantageous to position the ribs 7 such that when the valve 8 is "closed" the ribs 7 are in alignment with the ridges 20. When valve 8 is positioned in the "closed" position for an extended period of time, e.g., two days, the memory of the plastic material forming port 5 permanently deforms to form grooves 21, thus enhancing the difficulty by which the valve may be opened.

As would be apparent to those skilled in the art, the valve of the present invention need not be integrally formed with the bag 3. If the application warranted, the port 5 could be replaced with a separate valve body having a through hole in which the valve stem 8 is inserted.

An infusion bag may be filled in accordance with the invention by the following preferred method.

With the valve 8 in the open position, connecting a filling tube to a filling end 10 of an elongated cylindrical body 8 of the valve 8;

filling the bag 3 with a desired fluid; and, closing the valve 8 by pulling the elongated cylindrical body 8 to a position such that there is no fluid communication between the filling end 10 of the valve 8 and the interior of the bag 3.

If the bag is of the type that is reusable, after the fluid has been emptied from the bag, it may be refilled by opening the valve 8 by pushing valve 8 to a position such that fluid communication between the filling end 10 and the interior of the bag is established and performing the foregoing steps.

If the bag is used in an application where reuse is not desirable, after filling the bag, the step of breaking off the filling portion of the cylindrical body should be performed.

While certain specific and preferred embodiments of the present invention have been illustrated herein, as will be understood by those skilled in the art, still further variations and modifications can be made therein without departing from the spirit and scope of the invention as claimed below.

I claim:

1. A filling system comprising:

a container defining a bladder and at least two ports, and a cylindrical body reciprocally inserted in one of said ports; said cylindrical body comprising a filling end and a bladder end; said filling end comprising grasping means for grasping; said cylindrical body comprising an axial bore formed partially therethrough and an aperture at said filling end, said cylindrical body including at least one passage formed between said filling and bladder ends in fluid communication with said bore; said passage being in fluid communication with said bladder when said cylindrical body is positioned in a first position, and said passage not being in fluid communication with said bladder when said cylindrical body is positioned in a second position, and means for securing said cylindrical body in said second position within said bore to prevent fluid communication with said container thereby to render said cylindrical body tamper resistant once said container is filled;

said securing means comprises a weakened area in said cylindrical body formed between said filling and said bladder ends so as to allow removal of said filling end when said cylindrical body is in said second position.

2. The filling system of claim 1 wherein said weakened area is defined by said passage between said filling and bladder ends.

3. The filling system of claim 1 wherein said securing means comprises one of more circumferential ridges formed on an outer diameter of said cylindrical body, said ridges forming complimentary grooves in said port receiving said cylindrical body when said cylindrical body is secured in said second position.

4. The filling system of claim 3 wherein said container is formed from a malleable, gas impermeable plastic.

5. A tamper-resistant system for filling a fluid container, comprising:

(a) a fluid container;

(b) at least one port attached to said container, said port having a bore which provides fluid communication between the interior and exterior of said container; and, (c) a valve member coaxially inserted within said bore, said valve member movable within said bore from a first position to a second position, fluid communication between said interior and exterior of said container through said bore being blocked when said valve member is positioned in said second position and fluid communication between said interior and exterior of said container through said bore being established when said valve member is in said first position, said valve member including means for securing said valve member in said second position within said bore to prevent fluid communication with said container thereby to render said valve member tamper resistant once said fluid container is filled, said means for securing said valve member comprises at least one radial ridge on said valve member, such that when said valve member is in said second position said ridges are substantially aligned with complementary grooves in said bore, and said valve member further comprising a weakened portion along its length forming a first end and a second end, said weakened portion formed so as to allow the second end of said valve member to be removed.

6. The system of claim 5 further comprising means for positioning said bag such that at least one of said ports has a downward orientation.

7. A valve comprising a valve body comprising a through hole having an interior wall and an inlet side and an outlet side;

an elongated body having a dimensional length greater than the length of said through hole reciprocally inserted in said through hole, said elongated body comprising a first end and a second end and a fluid communication means for providing fluid communication from a first opening at said first end to a second opening at a point along said length of said elongated body;

positioning means for positioning said elongated body to provide fluid communication from said inlet side of said valve body to said outlet side of said valve body through said fluid communication means when said elongated body is in a first position and prevent fluid communication from said inlet side of said valve body to said outlet side of said valve body when said elongated body is positioned in a second position; and, said elongated body comprising a break off means for breaking off said first end of said elongated body when said elongated body is in said second position.

* * * * *